US012569083B2

(12) United States Patent
Thompson et al.

(10) Patent No.: US 12,569,083 B2
(45) Date of Patent: Mar. 10, 2026

(54) ACTIVELY COOLED PILLOW

(71) Applicant: Sleep Number Corporation, Minneapolis, MN (US)

(72) Inventors: Seth Thompson, Carthage, MO (US); Charles Wilson, Fayetteville, AR (US); Matthew D. McKnight, Fort Smith, AR (US); Sydney Wells, Fort Smith, AR (US)

(73) Assignee: Sleep Number Corporation, Minneapolis, MN (US)

( * ) Notice: Subject to any disclaimer, the term of this patent is extended or adjusted under 35 U.S.C. 154(b) by 474 days.

(21) Appl. No.: 18/171,488

(22) Filed: Feb. 20, 2023

(65) Prior Publication Data

US 2024/0277166 A1 Aug. 22, 2024

(51) Int. Cl.
*A47G 9/10* (2006.01)

(52) U.S. Cl.
CPC ..... *A47G 9/1036* (2013.01)

(58) Field of Classification Search
CPC .... A47C 7/744; A47C 21/044; A47G 9/1036; A61G 5/1048; A61G 7/05784; A61G 7/05792
See application file for complete search history.

(56) References Cited

U.S. PATENT DOCUMENTS

| | | | | |
|---|---|---|---|---|
| 8,181,290 | B2 | 5/2012 | Brykalski et al. | |
| 8,332,975 | B2 | 12/2012 | Brykalski et al. | |
| 9,125,497 | B2 | 9/2015 | Brykalski et al. | |
| 9,131,781 | B2 | 9/2015 | Zaiss et al. | |
| 9,314,118 | B2 | 4/2016 | Blazar et al. | |
| 9,974,394 | B2 | 5/2018 | Brykalski et al. | |
| 10,772,438 | B2 | 9/2020 | Griffith et al. | |
| 11,962,164 | B2 | 4/2024 | Holmvik et al. | |
| 12,127,678 | B2 | 10/2024 | Sayadi et al. | |
| 2005/0278863 | A1* | 12/2005 | Bahash | A47C 21/044 5/652.2 |
| 2015/0272354 | A1* | 10/2015 | Asklof | A47C 7/18 5/636 |
| 2016/0066716 | A1 | 3/2016 | Rao | |
| 2017/0280883 | A1 | 10/2017 | Diller | |
| 2020/0000241 | A1* | 1/2020 | Jansen | A47C 17/04 |
| 2021/0177166 | A1* | 6/2021 | Lemieux | F24H 9/12 |
| 2021/0204713 | A1 | 7/2021 | Karschnik et al. | |
| 2022/0261020 | A1 | 8/2022 | Garcia Molina et al. | |
| 2022/0273115 | A1 | 9/2022 | Karschnik et al. | |

(Continued)

FOREIGN PATENT DOCUMENTS

| | | | |
|---|---|---|---|
| CN | 1310592 | A | 8/2001 |
| CN | 200953974 | Y * | 10/2007 |

(Continued)

*Primary Examiner* — Eric J Kurilla
(74) *Attorney, Agent, or Firm* — Fish & Richardson P.C.

(57) ABSTRACT

A pillow uses a fan assembly in the pillow to cool the sleeping surface of the pillow. The fan assembly uses two fans to move ambient air through a middle layer of reticulated foam and then through air passages extending through at least one layer of foam. A bottom piece of foam is either semi-permeable or impermeable to airflow so that most, if not all, of the air moved by the fans exits the top of the pillow to cool the pillow. A chargeable power source powers the fans via a circuit board which may have an LED light to indicate the status of the power source.

20 Claims, 8 Drawing Sheets

(56) References Cited

U.S. PATENT DOCUMENTS

| | | | |
|---|---|---|---|
| 2024/0099485 | A1 | 3/2024 | Stojanovic et al. |
| 2024/0358166 | A1 | 10/2024 | Palashewski et al. |

FOREIGN PATENT DOCUMENTS

| | | | | | |
|---|---|---|---|---|---|
| CN | 205234007 | U | * | 5/2016 | |
| CN | 210169518 | U | * | 3/2020 | |
| GB | 2496166 | A | * | 5/2013 | ..... A47G 9/1036 |
| KR | 20160123109 | A | * | 10/2016 | ..... A47G 9/1045 |

* cited by examiner

ACTIVELY COOLED PILLOW

FIELD OF THE INVENTION

This invention relates generally to bedding products and, more particularly, to a pillow cooling system.

BACKGROUND OF THE INVENTION

Conventional molded foam pillows are usually made of one piece of foam with uniform properties throughout the foam piece. A cover surrounds the piece of foam. The shape of the molded piece of foam may vary depending upon consumer preference.

One common complaint about conventional molded foam pillows is that the sleeping surface becomes warm or even hot over time. This may cause the head and/or neck of the person sleeping on the pillow to sweat. Such sweating may awaken the person sleeping on the pillow. In some extreme conditions, the sweat or perspiration may cause the pillow's user to become ill with for example, a cold.

Another drawback to known conventional molded foam pillows is that over time the foam of the pillow may lose its resiliency or bounce back properties.

In view of the above, there is a need for a molded foam pillow made of multiple pieces of foam which is more breathable than a standard molded pillow made of one piece of foam. There is further a need for a foam pillow having an internal mechanism for moving air through a portion of the pillow to cool a sleeping surface of the pillow.

It is therefore an objective of this invention to provide breathable pillow having an active cooling system which may be used to cool a foam pillow.

It is further an objective of this invention to provide a breathable pillow having an insert or core which is more breathable than an external portion to improve airflow through the pillow.

SUMMARY OF THE INVENTION

According to one aspect of the invention, an actively cooled pillow comprises a lower foam piece, an upper foam piece and a middle foam piece between the upper and lower foam pieces. The upper foam piece has air passages extending through the upper foam piece. The middle foam piece is typically made of reticulated foam but may be made of any known foam or fiber material which allows air to flow through the material.

The actively cooled pillow further comprises a fan assembly comprising a power source, multiple fans, a circuit board, a circuit board housing, a fan control and a USB charging port. The fan control may be an on-off switch or a rotary fan control to control the speed of variable speed fans. The power source in some embodiments may be a battery including, but limited to, a pouch battery.

The fans pull ambient air though the middle foam piece and though the air passages of the upper foam piece to cool the pillow. The lower foam piece may be made of foam impermeable to airflow or semi-permeable to airflow.

According to another aspect of the invention, the actively cooled pillow comprises a lower foam piece, an upper foam piece and a middle foam piece between the upper and lower foam pieces. The upper and lower foam pieces each have air passages extending through the upper foam piece. The middle foam piece is typically made of reticulated foam but may be made of any known foam or fiber material which allows air to flow through the material.

The actively cooled pillow further comprises a fan assembly comprising a power source, two fans, a circuit board wired to each of the fans, a circuit board housing, a fan control and a charging port secured to the circuit board housing. The fan control may be a fan with on-off capability or a rotary fan control to control the speed of variable speed fans. The power source in some embodiments is a battery including, but limited to, a pouch battery. The pillow may further comprise a LED light to indicated when the power source is charged.

According to another aspect of the invention, a method of cooling the sleeping surface of a pillow is provided. The method comprises providing a pillow comprising a lower foam piece, an upper foam piece with air passages extending through the upper foam piece and a middle piece of reticulated foam between the upper and lower foam pieces. The method further comprises rotating a fan control to turn on two fans on one side of the pillow to pull ambient air though the fans, through the middle piece of reticulated foam and then through the air passage extending through the upper foam piece of the pillow.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
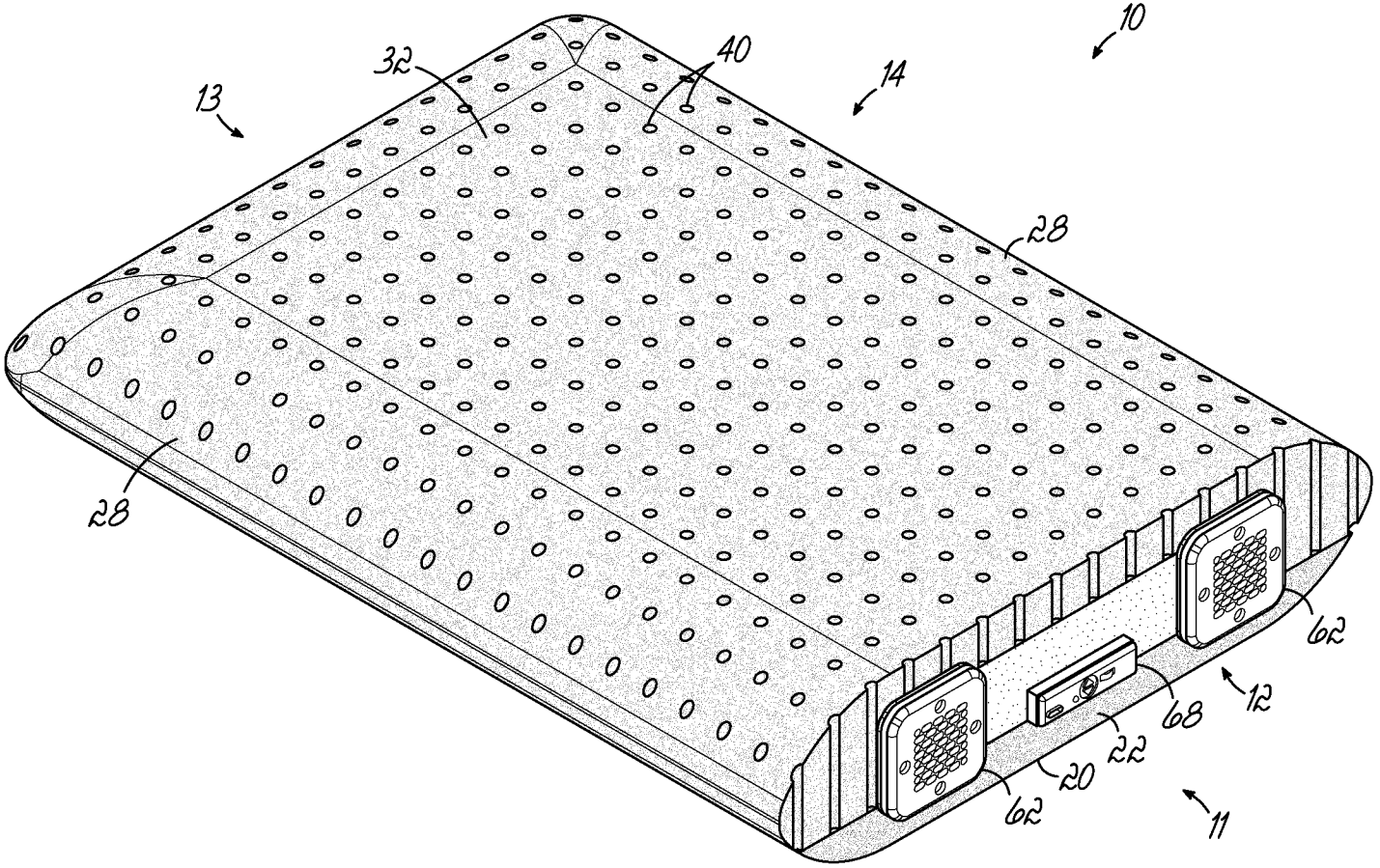
FIG. 1 is a perspective view of an actively cooled pillow in accordance with the present invention.
Figure 2:
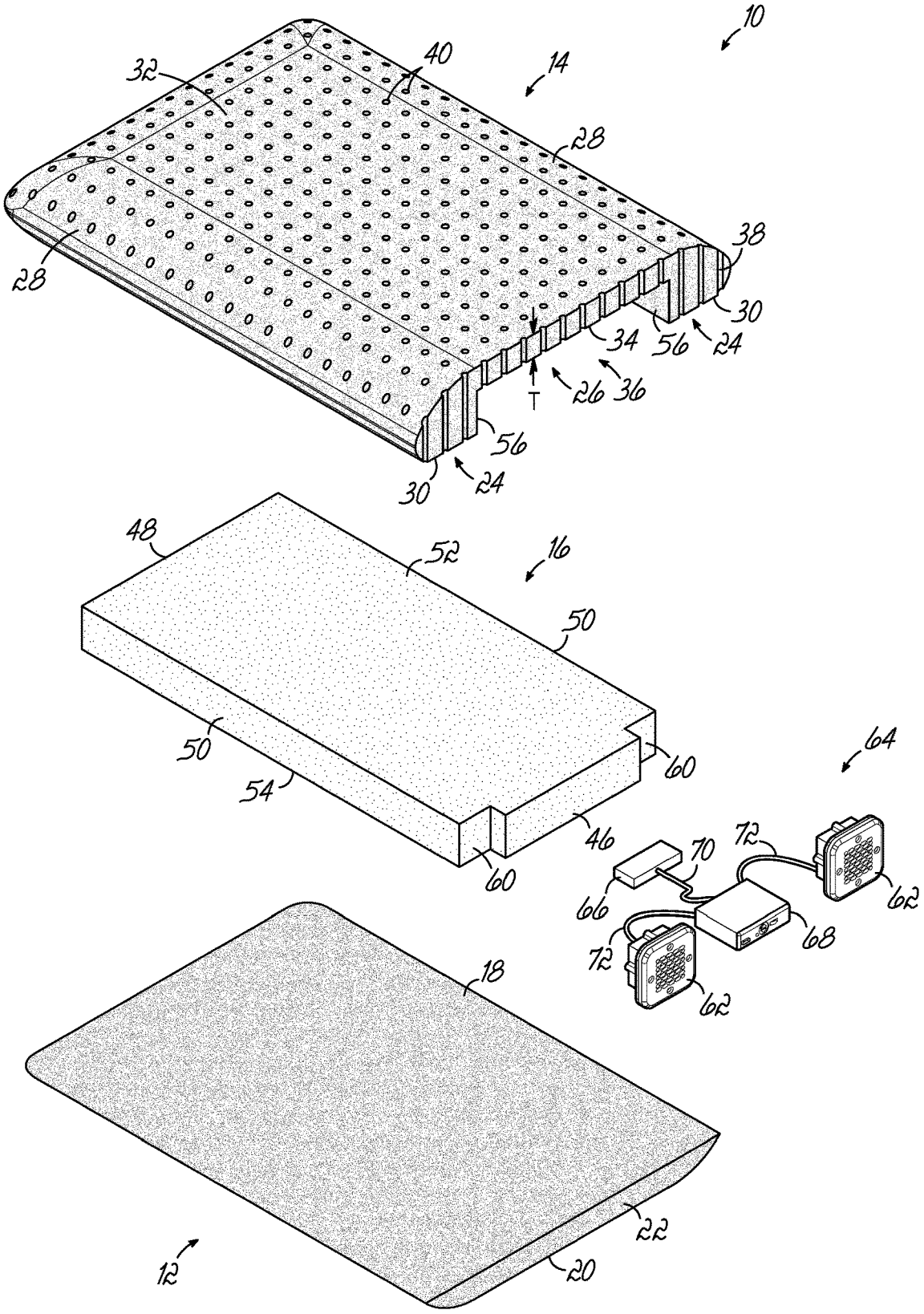
FIG. 2 is a disassembled perspective view of the pillow of FIG. 1.

Referring to FIGS. 1 and 2, a pillow 10 comprises a lower foam piece 12, an upper foam piece 14 and a middle piece of foam 16 between the upper and lower foam pieces 12, 14, respectively. Referring to FIG. 1, the pillow 10 has a front 11 and a rear 13. Although FIG. 1 illustrates one size of pillow 10, the size and/or shape of the pillow 10 is not intended to be limited by the drawings.

As best shown in FIG. 2, the lower foam piece 12 has a generally planar upper surface 18, a curved lower surface 20 and generally planar side surfaces 22. Although shown as a single piece of foam, the lower foam piece 12 may comprise multiple pieces or segments of foam joined together. The generally planar side surfaces 22 are at the front and back of the lower foam piece 12.

The upper foam piece 14 is generally U-shaped, having two side sections 24 of variable thickness and a middle section 26 of a uniform thickness "T". The upper foam piece 14 may be made of one or multiple pieces of foam joined together. Each of the side sections 24 has a curved upper surface 28 and a flat or generally planar lower surface 30. The middle section 26 has a generally planar upper surface 32 and a generally planar lower surface 34, the linear distance between the upper and lower surfaces 32, 34 defining the uniform thickness "T" of the middle section 26.

Figure 3:
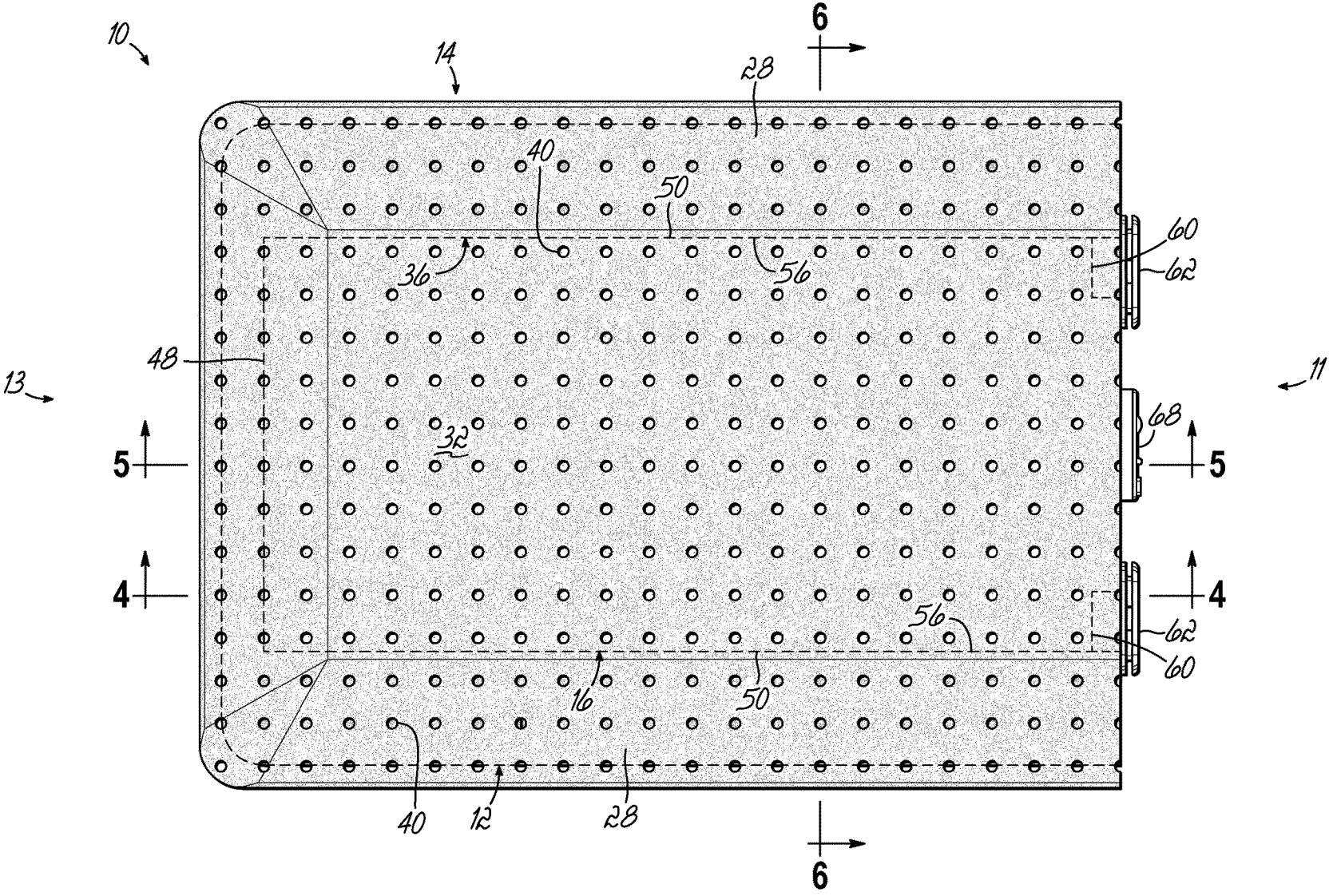
FIG. 3 is a top view of the pillow of FIG. 1.

Between the side sections 24 and below the middle section 26 of the upper foam piece 14 is a cutout 36 adapted to receive the middle piece of foam 16. The size of the cutout 36 is shown by dashed lines shown in FIG. 3. The cutout 36 is defined between generally planar side surfaces 56 and the generally planar lower surface 34 of the middle section 26 of the upper foam piece 14.

As best shown in FIG. 2, multiple parallel air passages 38 extend through each of the sections 24, 26 of the upper foam piece 14. Each of the air passages 38 is cylindrical in shape, having a circular cross-section, a circular upper opening 40 and a circular lower opening 42. However, these air passages may be any desired cross-sectional shape such as rectangular in cross-section and have openings of any desired size and/or shape. The drawings are not intended to be limiting.

Figure 4:
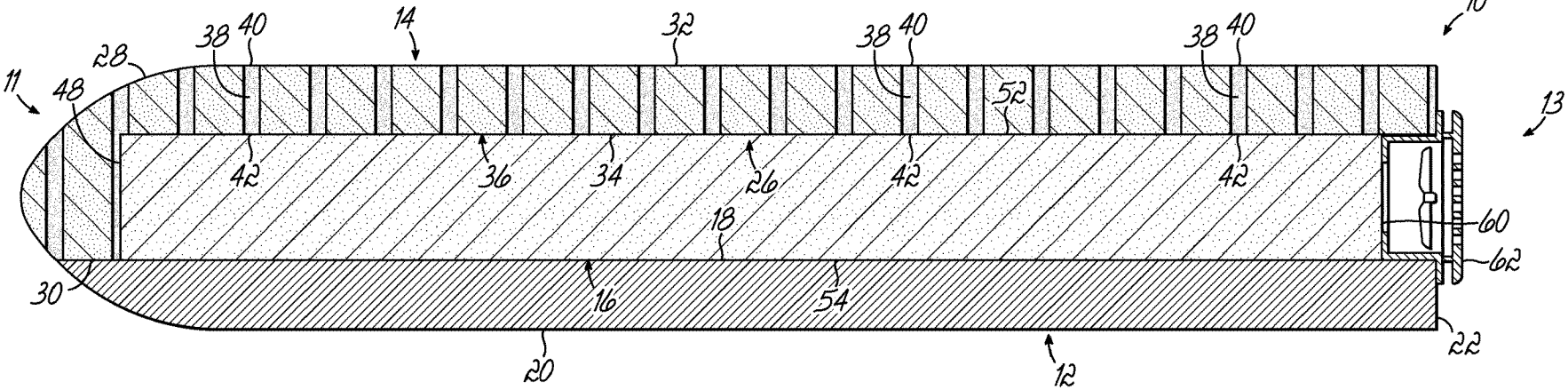
FIG. 4 is a cross-sectional view of the pillow of FIG. 3 taken along the line 4-4 of FIG. 3.
Figure 5:
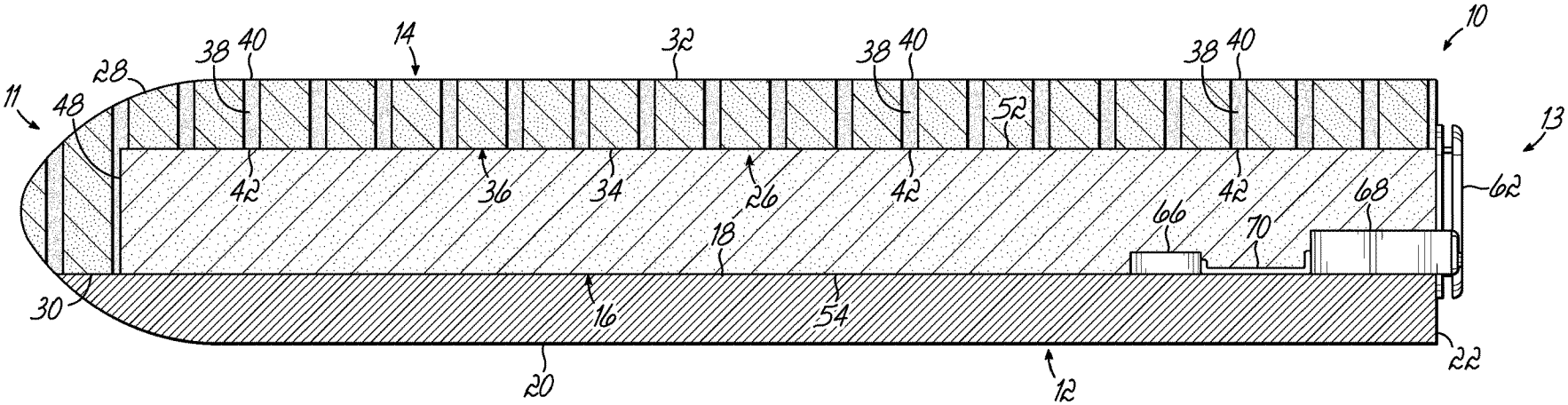
FIG. 5 is a cross-sectional view of the pillow of FIG. 3 taken along the line 5-5 of FIG. 3.
Figure 6:
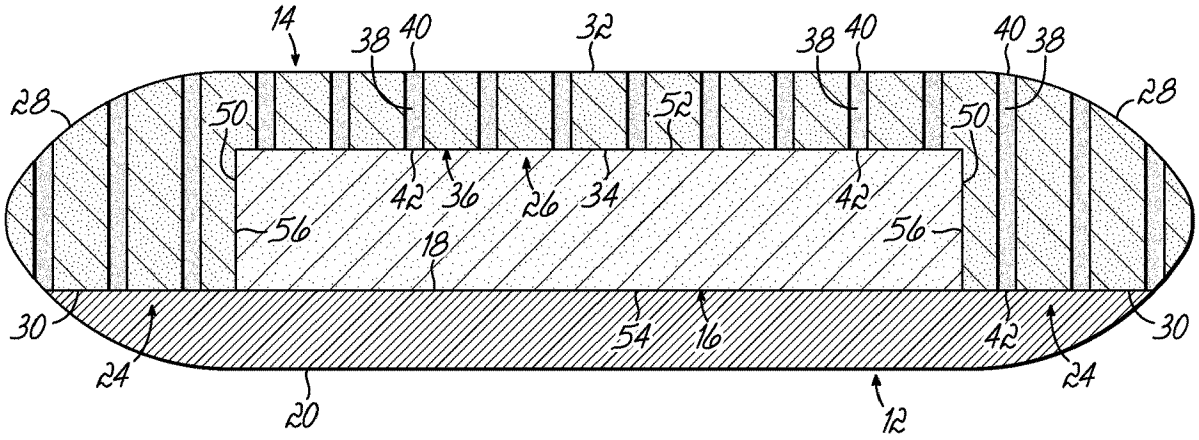
FIG. 6 is a cross-sectional view of the pillow of FIG. 3 taken along the line 6-6 of FIG. 3.

As best shown in FIG. 2, the middle piece of foam 16 has a generally planar front surface 46, a generally planar rear surface 48, opposed generally planar side surfaces 50, a generally planar top surface 52 and a generally planar bottom surface 54. As shown in FIGS. 4 and 5, upon assembly, the generally planar top surface 52 of the middle piece of foam 16 contacts the lower surface 34 of the middle section 26 of the upper foam piece 14. Similarly, the generally planar bottom surface 54 of the middle piece of foam 16 contacts the generally planar upper surface 18 of the lower foam piece 12. Lastly, each generally planar side surface 50 of the middle piece of foam 16 contacts one of the generally planar side surfaces 56 of the cutout 36 formed in the upper foam piece 14.

As best shown in FIG. 2, the middle piece of foam 16 has two recesses 60 on opposite sides of the middle piece of foam 16 at the front of the middle piece of foam 16. Each of the recesses 60 is sized to receive one of the fans 62 of the fan assembly 64 described below. Although one style of fan 62 is shown, any known fan may be used. Again, the drawings are not intended to be limiting. The fans 62 are placed against the middle piece of foam 16 and oriented to move ambient air from outside the pillow 10 towards the middle piece of foam 16.

Figure 8:
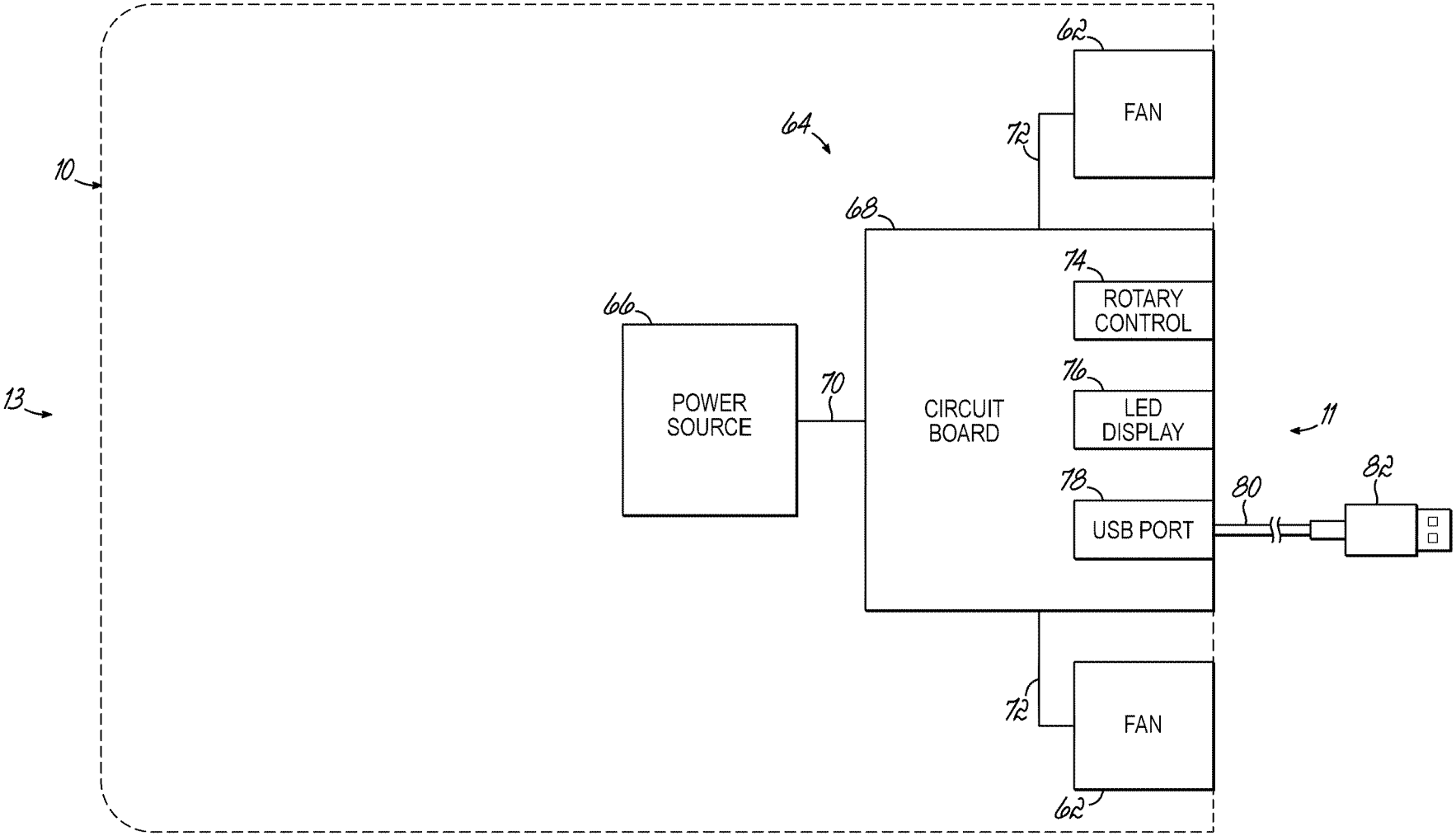
FIG. 8 is a diagrammatic view of the pillow of FIG. 3 showing the electronic components.

As best shown in FIGS. 2 and 8, the fan assembly 64 is located generally at the front 11 of the pillow 10 but may be located differently than shown. The drawings are not intended to be limiting. The fan assembly 64 is powered by a power source 66 which is typically a pouch battery but may be any battery. The power source 66 is wired to a circuit board 68 with a battery harness 70. The circuit board 68 is housed within a circuit board housing and wired to each of the fans 62 with a wire 72.

The fan assembly 64 further comprises a rotary fan control 74 which is used to turn the fans 62 on or off. Although not shown, it is within the scope of the present invention that the fan control is not rotary but merely an on/off switch and the fans have only one speed.

The fan assembly 64 further comprises a light emitting diode ("LED") display 76 for showing when the fan assembly 64 is in use. In some embodiments, the LED display may be omitted.

The fan assembly 64 further comprises a USB port 78 which enables the power source 66 to be charged via a USB cable 80 which plugs into an outlet using a plug 82. See FIG. 8. The USB cable 80 and plug 82 are not part of the fan assembly 64 which is part of the pillow 10.

Figure 7:
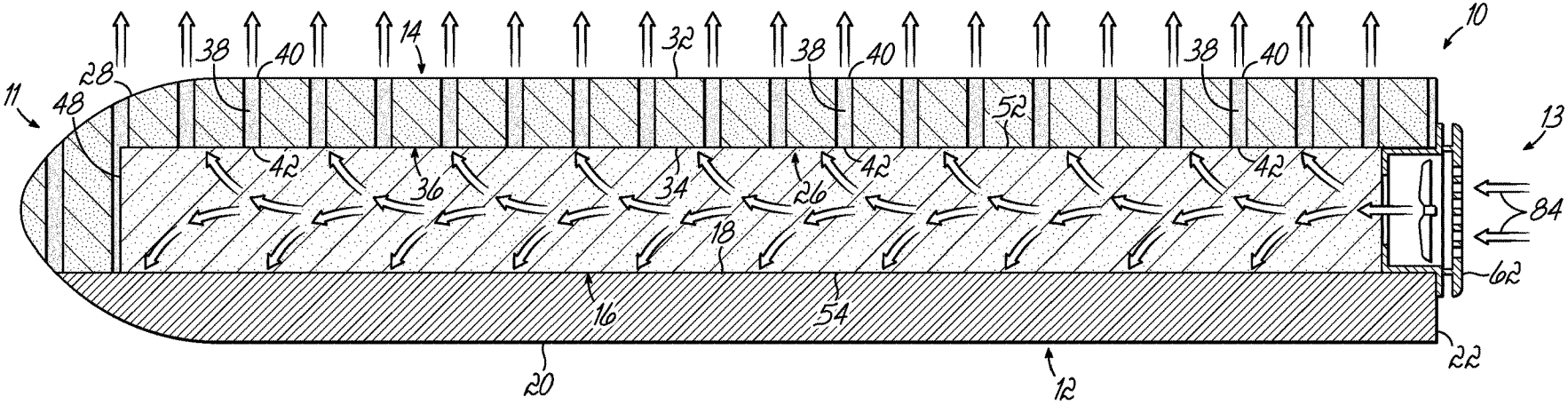
FIG. 7 is a cross-sectional view of the pillow of FIG. 3 showing the airflow through the pillow.

FIG. 7 shows airflow through the pillow 10 according to one embodiment of the present invention. Ambient air is pulled into the pillow 10 via the two fans 62 as shown by the arrows 84 of FIG. 7. The air is pulled through the middle piece of foam 16 and into the air passages 38 of the upper foam piece 14 of pillow 10 through the lower openings 42 of the air passages 38. The air flows upwardly and outwardly through the upper openings 40 of the upper foam piece 14 of pillow 10 and into the environment. In the embodiment shown in FIGS. 1-7, the lower foam piece 12 of pillow 10 is impermeable to airflow.

Figure 9:
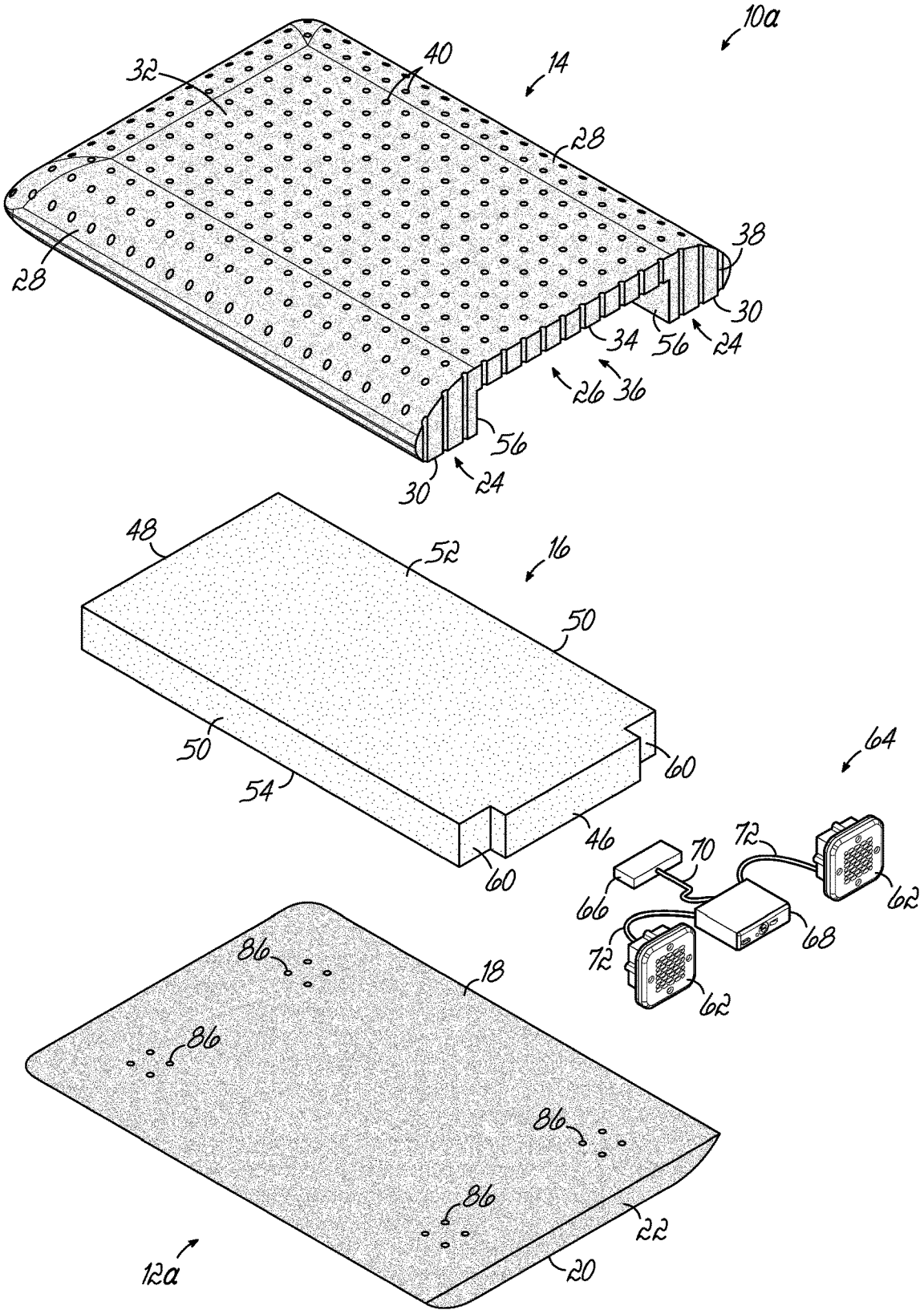
FIG. 9 is a disassembled perspective view of another embodiment of pillow.
Figure 10:
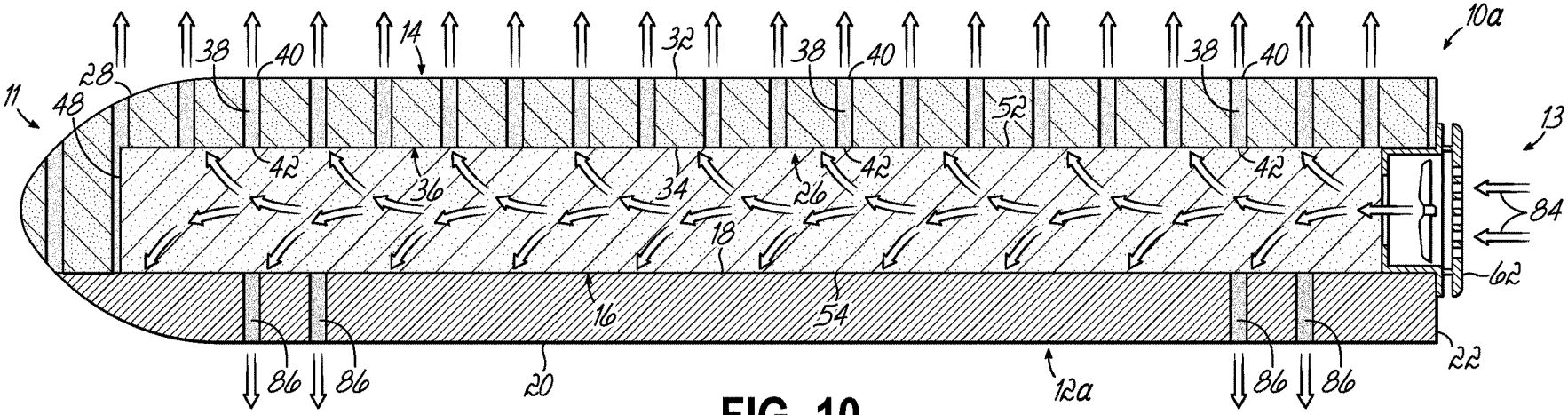
FIG. 10 is a cross-sectional view of the pillow of FIG. 9 showing the airflow through the pillow.

FIGS. 9 and 10 illustrate an alternative embodiment of pillow 10*a* having the same shape and size as pillow 10 shown in FIGS. 1-7. The pillow 10*a* has a different lower foam piece 12*a* than the lower foam piece 12 of the pillow 10. The lower foam piece 12*a* is semi-impermeable to airflow rather than fully impermeable to airflow like lower foam piece 12. The other components of the pillow 10*a* are identical to the components of pillow 10 and for sake of simplicity are designed with the same numbers.

The lower piece of foam 12*a* is shown having air passages 86 extending through the lower piece of foam 12*a*. Although FIG. 9 shows four air passages 86 extending through the lower piece of foam 12*a* at each corner, the drawings are not intended to be limiting. Any number of air passages may extend through the lower piece of foam 12*a* at any desired locations to make the lower piece of foam 12*a* semi-impermeable to airflow. FIG. 10 shows the airflow pattern illustrating some air passing through the lower piece of foam 12*a* and escaping out the bottom of the pillow 10*a*.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An actively cooled pillow comprising:

a lower foam piece;

an upper foam piece with air passages extending through the upper foam piece;

a middle piece of reticulated foam between the upper and lower foam pieces, a fan assembly comprising a power source, multiple fans positioned at a front side of the middle piece of reticulated foam between the upper foam piece and the lower foam piece, and a circuit board housing in which is located a circuit board wired to each of the fans, the fan assembly further comprising a fan control and a USB charging port;

wherein upon activation of the fans via the fan control, the fans move ambient air through the middle piece of reticulated foam and the air passages of the upper foam piece transferring heat away from the pillow.

2. The pillow of claim 1, wherein the lower foam piece is made of foam impermeable to airflow.

3. The pillow of claim 1, wherein the lower foam piece is made of foam semi-permeable to airflow.

4. The pillow of claim 1, wherein the fan control is a rotary fan control, and the middle piece of reticulated foam includes two recesses that extend into the front side of the middle piece of reticulated foam on opposite sides of a middle portion of the front side of the middle piece of reticulated foam.

5. The pillow of claim 1, wherein the fan assembly further comprises a LED light to indicate when the power source is charging.

6. The pillow of claim 1, wherein the power source is a battery.

7. The pillow of claim 6, wherein the battery is a pouch battery.

8. An actively cooled pillow comprising:

a lower foam piece having air passages extending through the lower foam piece;

an upper foam piece with air passages extending through the upper foam piece;

a middle piece of foam between the upper and lower foam pieces, a fan assembly comprising a power source, two fans and a circuit board wired to each of the fans, the fan assembly further comprising a fan control with on/off capability and a charging port secured to a circuit board housing, wherein the two fans are positioned at a front side of the middle piece of foam between the upper foam piece and the lower foam piece;

wherein upon activation of the fans via a rotary fan control, the fans move ambient air through the air passages of the upper foam piece transferring heat away from the pillow.

9. The pillow of claim 8, wherein the lower foam piece is made of foam impermeable to airflow, and the air passages through the lower foam piece are positioned at four corners of the lower foam piece and separated from a middle section of the lower foam piece.

10. The pillow of claim 8, wherein the lower foam piece is semi-permeable to airflow.

11. The pillow of claim 8, wherein the middle piece of foam is reticulated foam.

12. The pillow of claim 8, wherein the fan assembly further comprises a LED light to indicate when the power source is charged.

13. The pillow of claim 8, wherein the power source is a battery.

14. The pillow of claim 13, wherein the battery is a pouch battery.

15. A method of cooling a pillow comprising:

providing a pillow comprising a lower foam piece;

an upper foam piece with air passages extending through the upper foam piece and a middle piece of reticulated foam between the upper and lower foam pieces;

rotating a fan control to turn on two fans on a front side of the middle piece of reticulated foam between the upper foam piece and the lower foam piece of the pillow to pull ambient air through the fans, through the middle piece of reticulated foam and then through the air passages extending through the upper foam piece of the pillow.

16. The method of claim 15, wherein the fan control controls a speed of the fans.

17. The method of claim 15, wherein the two fans are wired to a circuit board powered by a pouch battery.

18. The method of claim 17, wherein the pouch battery is powered by a USB cable.

19. The method of claim 17, wherein a battery harness connects the pouch battery to the circuit board.

20. The method of claim 15, wherein an LED display shows whether a battery is charged.

* * * * *